US005884607A

United States Patent [19]

Schiller et al.

[11] Patent Number: 5,884,607

[45] Date of Patent: Mar. 23, 1999

[54] FUEL DELIVERY SYSTEM FOR A VEHICLE

[75] Inventors: Gottfried Schiller, Howell; John Casari, Manchester, both of Mich.; Tony Wheeler, Anderson, S.C.

[73] Assignee: Robert Bosch GmbH, Stuttgart, Germany

[21] Appl. No.: 954,897

[22] Filed: Oct. 21, 1997

[30] Foreign Application Priority Data

Oct. 21, 1996 [DE] Germany ..... 196 43 295.2

[51] Int. Cl.[6] ..... F02M 37/04

[52] U.S. Cl. ..... 123/467; 123/447

[58] Field of Search ..... 123/447, 467, 123/456, 514, 468, 469

[56] References Cited

U.S. PATENT DOCUMENTS

| | | | |
|---|---|---|---|
| 3,026,928 | 3/1962 | Phillips | 123/456 |
| 3,507,263 | 4/1970 | Long | 123/456 |
| 4,440,134 | 4/1984 | Nakao | 123/447 |
| 4,526,751 | 7/1985 | Tateishi | 123/468 |
| 5,207,203 | 5/1993 | Wagner | 123/456 |
| 5,592,968 | 1/1997 | Nakashima | 123/456 |
| 5,752,486 | 5/1998 | Nakashima | 123/447 |

FOREIGN PATENT DOCUMENTS

| | | | |
|---|---|---|---|
| 0653020 | 6/1996 | European Pat. Off. . | |
| 19536458 | 4/1996 | Germany . | |
| 19544241 A1 | 6/1996 | Germany . | |
| 196 00 515 | 7/1996 | Germany . | |
| 19543967 | 5/1997 | Germany . | |
| 6066221 | 3/1994 | Japan | 123/447 |

*Primary Examiner*—Carl S. Miller

*Attorney, Agent, or Firm*—Edwin E. Greigg; Ronald E. Greigg

[57] ABSTRACT

It has been determined that a fuel delivery system with a fuel supply line and electromagnetically actuatable fuel injection valves produce fuel oscillations during opening and closing of the fuel injection valves and therefore generates noise, which is transmitted into the passenger compartment of the vehicle and annoys the passengers. In order to damp this kind of noise, at least one elongated, hollow damping body is connected at right angles to the fuel supply line and has a closed end. The axial length of the hollow damping body corresponds to 1½ times the wavelength of the fuel oscillation to be damped in the fuel supply line. The length of the at least one damping body can also correspond to 1½ times the wavelength of the fuel oscillation to be damped in the fuel supply line, divided by 2 or by a multiple of 2. The fuel delivery system is particularly suited for mixture compressing internal combustion engines with externally supplied ignition.

16 Claims, 1 Drawing Sheet

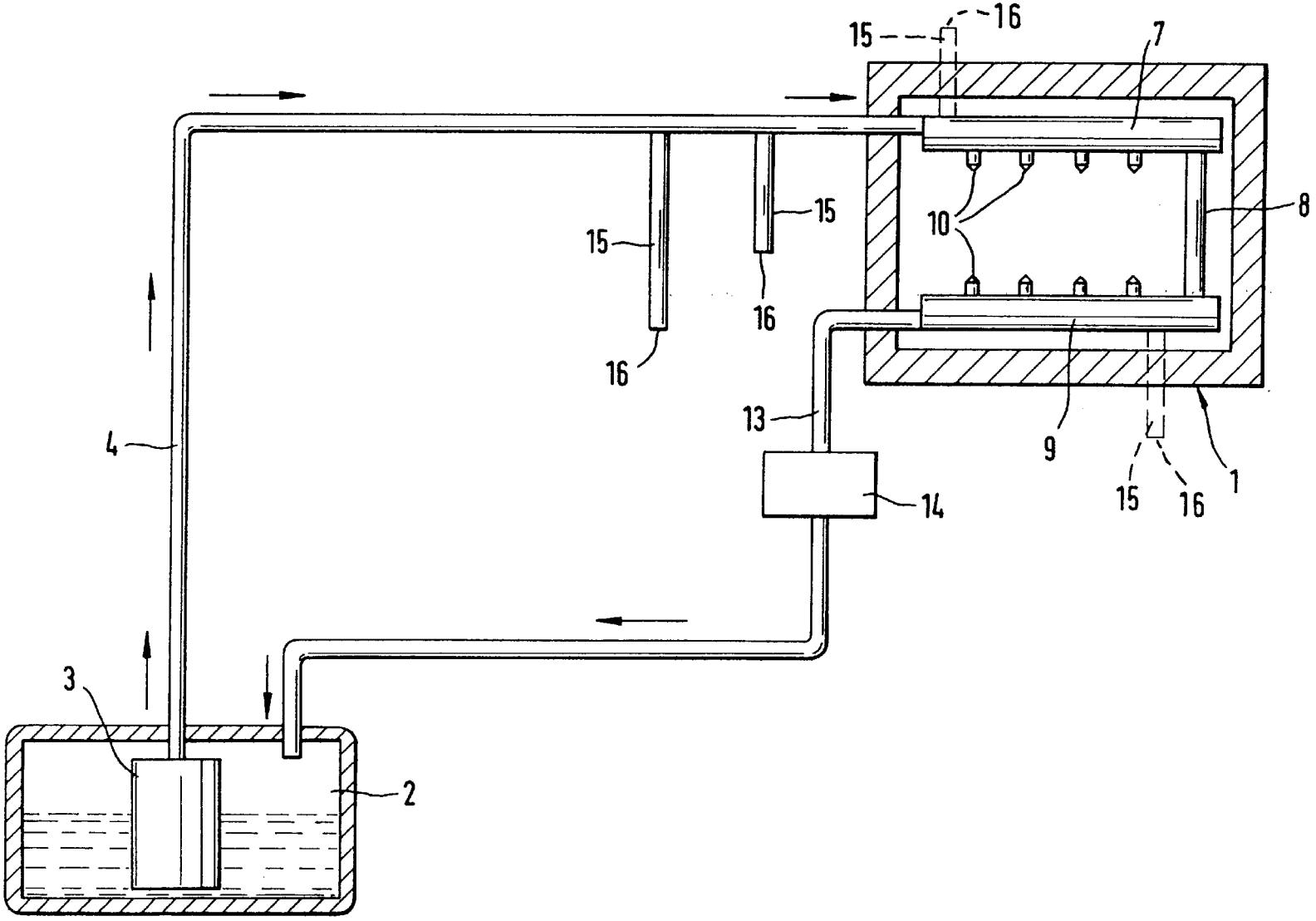
8
7
16
15
10
1
16
15
9
14
13
15
16
15
16
2
4
3

FUEL DELIVERY SYSTEM FOR A VEHICLE

BACKGROUND OF THE INVENTION

The invention is based on a fuel delivery system for a vehicle. In fuel delivery systems of this kind, the rapid opening and closing of the electromagnetically actuated fuel injection valves leads to oscillations in the fuel pump of the fuel injection system and leads to an annoying hammering noise which is transmitted into the passenger compartment of a vehicle. In air inlet systems for internal combustion engines, an already known strategy is to produce standing waves in order to damp the air oscillations produced by the engine, which likewise lead to unpleasant noise in the passenger compartment of the vehicle (EP 0 653 020 B1). A device of this kind, however, is not suitable for installation in a fuel delivery system.

OBJECT AND SUMMARY OF THE INVENTION

The fuel delivery system according to the invention has the advantage that annoying fuel oscillations are damped in a simple manner.

Advantageous improvements and updates of the fuel delivery system are possible by means of the measures taken hereinafter.

It is particularly advantageous to connect at least two damping bodies of different lengths to the fuel supply line or the fuel distributor line in order to consequently damp fuel oscillations at different speeds of the engine.

It is likewise advantageous to embody each damping body out of the same material and with the same cross sectional dimensions as the fuel supply line or the fuel distributor line.

In order to achieve the standing waves required for damping the fuel oscillations, it is necessary to embody the length of the damping body corresponding to 1½ times the wavelength of the fuel oscillation to be damped, or corresponding to 1½ times this wavelength, divided by 2 or by a multiple of 2.

The invention will be better understood and further objects and advantages thereof will become more apparent from the ensuing detailed description of preferred embodiments taken in conjunction with the drawing.

BRIEF DESCRIPTION OF THE DRAWING

The sole FIGURE is a schematic drawing of the full injection system.

DESCRIPTION OF THE PREFERRED EMBODIMENTS

The drawing shows a simplified depiction of a fuel delivery system for a mixture compressing internal combustion engine 1 with externally supplied ignition, which is embodied by way of example as a V8 engine with eight cylinders. A fuel pump 3 disposed in a fuel tank 2 serves as a fuel delivery device and delivers fuel into a fuel supply line 4. The fuel supply line 4 is connected to a first fuel distributor line 7 which is disposed on the engine 1 and communicates with a second fuel distributor line 9 via a connecting line 8. Four electromagnetically actuatable fuel injection valves 10 are respectively inserted into each of the first fuel distributor line 7 and the second fuel distributor line 9 and these valves inject fuel in a known manner either indirectly upstream of the inlet valves of each cylinder or directly into each cylinder of the engine 1. Signals of an electronic control device, not shown, trigger the electromagnetically actuatable fuel injection valves 10 in a known manner. The downstream end of the second fuel distributor line 9 is connected to a return flow line 13 via which the fuel not injected by the fuel injection valves 10 can flow back to the fuel tank 2. A pressure regulating valve 14 of a known type is disposed in the return flow line 13 and keeps the fuel pressure in the fuel distributor lines 7, 9 and the fuel supply line 4 constant.

The opening and closing of the electromagnetically actuatable fuel injection valves 10 does not lead to fuel oscillations in the fuel supply line 4, nor does it lead to knocking noise, which is transmitted into the passenger compartment of the vehicle and which the passengers find unpleasant. At least one damping body 15 is connected to the fuel supply line 4 in order to damp these fuel oscillations and along with them, the unpleasant noise. The damping body is embodied as hollow and has an elongated tubular shape with a closed end 16 remote from the fuel supply line 4. Between the fuel supply line 4 and the interior of the damping body 15, there is an unhindered flow connection for the fuel to the closed end 16. The damping body 15 extends in its axial span at right angles to the fuel supply line 4 and is for example made of the same material and with the same cross sectional dimensions as the fuel supply line 4. The axial length of the damping body 15 corresponds either to 1½ times the wavelength of the fuel oscillation to be damped in the fuel supply line 4, or to 1½ times the wavelength of the fuel oscillation to be damped in the fuel supply line, divided by 2 or divided by a multiple of 2. By means of this adaptation of the axial length of the damping body 15 to the wavelength of the fuel oscillations to be damped, standing waves are produced in the damping body 15, which lead to a damping of the fuel oscillations and along with them, of the unpleasant noise in the fuel supply line 4. In the exemplary embodiment according to the sole Fig., for example two damping bodies 15 with different axial lengths are provided so that different fuel oscillations in the fuel supply line 4, which are produced at different speeds of the engine 1, can be damped since the axial lengths of these damping bodies 15 are adapted to the different wavelengths of these different fuel oscillations.

It is advantageous to dispose at least one damping body 15 in the immediate proximity of at least the first fuel distributor line 7. At least one damping body 15 can also be disposed directly on one or both of the fuel distributor lines 7, 9, as shown with dashed lines.

The foregoing relates to preferred exemplary embodiments of the invention, it being understood that other variants and embodiments thereof are possible within the spirit and scope of the invention, the latter being defined by the appended claims.

We claim:

1. A fuel delivery system which includes a fuel delivery device, said fuel delivery device includes at least one fuel supply line, and at least one fuel distributor line connected to said fuel supply line and to electromagnetically actuatable fuel injection valves for each cylinder of an engine, at least one hollow, elongated damping body (15) is connected to said fuel supply line and disposed at right angles to said fuel supply line, an end (16) of said damping body (15) remote from the fuel supply line (4) is closed and has a length such that fuel oscillations are damped through a formation of standing waves in said hollow elongated damping body.

2. A fuel delivery system according to claim 1, in which at least two spaced damping bodies (15) of different lengths are connected to the fuel supply line (4).

3. A fuel delivery system according to claim 1, in which each damping body (15) is made of the same material and with a same cross sectional dimension as the fuel supply line (4).

4. A fuel delivery system according to claim 2, in which each damping body (15) is made of the same material and with a same cross sectional dimension as the fuel supply line (4).

5. A fuel delivery system according to claim 1, in which a length of the at least one damping body (15) corresponds to 1½ times a wavelength of the fuel oscillation to be damped in the fuel supply line (4).

6. A fuel delivery system according to claim 2, in which a length of the at least one damping body (15) corresponds to 1½ times a wavelength of the fuel oscillation to be damped in the fuel supply line (4).

7. A fuel delivery system according to claim 1, in which a length of the at least one damping body (15) corresponds to 1½ times a wavelength of the fuel oscillation to be damped in the fuel supply line (4), divided by 2 or divided by a multiple of 2.

8. A fuel delivery system according to claim 2, in which a length of the at least one damping body (15) corresponds to 1½ times a wavelength of the fuel oscillation to be damped in the fuel supply line (4), divided by 2 or divided by a multiple of 2.

9. A fuel delivery system which comprises a fuel delivery device, said fuel delivery device includes at least one fuel supply line, and at least one fuel distributor line connected to said fuel supply line and to electromagnetically actuatable fuel injection valves for each cylinder of an engine, at least one hollow, elongated damping body (15) is connected to said at least one fuel distributor line (7, 9) and disposed at right angles to said at least one fuel distributor line (7, 9), an end (16) of said damping body (15) remote from the fuel distributor line (7, 9) is closed and has a length such that fuel oscillations are damped through a formation of standing waves in said damping body.

10. A fuel delivery system according to claim 9, in which at least two damping bodies (15) of different lengths are connected to the fuel distributor line (7, 9).

11. A fuel delivery system according to claim 9, in which each of the damping bodies (15) is made of the same material and with a same cross sectional dimension as the fuel distributor line (7, 9).

12. A fuel delivery system according to claim 10, in which each of the damping bodies (15) is made of the same material and with a same cross sectional dimension as the fuel distributor line (7, 9).

13. A fuel delivery system according to claim 9, in which the length of the at least one damping body (15) corresponds to 1½ times a wavelength of the fuel oscillation to be damped in the fuel distributor line (7, 9).

14. A fuel delivery system according to claim 10, in which the length of the at least one damping body (15) corresponds to 1½ times a wavelength of the fuel oscillation to be damped in the fuel distributor line (7, 9).

15. A fuel delivery system according to claim 9, in which the length of the at least one damping body (15) corresponds to 1½ times a wavelength of the fuel oscillation to be damped in the fuel distributor line (7, 9), divided by 2 or divided by a multiple of 2.

16. A fuel delivery system according to claim 10, in which the length of the at least one damping body (15) corresponds to 1½ times a wavelength of the fuel oscillation to be damped in the fuel distributor line (7, 9), divided by 2 or divided by a multiple of 2.

* * * * *